US012471705B2

(12) United States Patent
Male

(10) Patent No.: US 12,471,705 B2
(45) Date of Patent: Nov. 18, 2025

(54) SLIDE-STOP DEVICE

(71) Applicant: Accuride International GmbH, Diez (DE)

(72) Inventor: Robert Male, Northampton (GB)

(73) Assignee: Accuride International GmbH, Diez (DE)

( * ) Notice: Subject to any disclaimer, the term of this patent is extended or adjusted under 35 U.S.C. 154(b) by 113 days.

(21) Appl. No.: 18/389,169

(22) Filed: Nov. 13, 2023

(65) Prior Publication Data

US 2024/0156259 A1 May 16, 2024

(30) Foreign Application Priority Data

Nov. 15, 2022 (DE) ..... 10 2022 130 217.2

(51) Int. Cl.
*A47B 88/477* (2017.01)

(52) U.S. Cl.
CPC .... *A47B 88/477* (2017.01); *A47B 2210/0018* (2013.01)

(58) Field of Classification Search
CPC ..... A47B 88/477; A47B 2210/0018; A47B 88/57; A47B 88/473; B60N 2/0727; E05F 5/06
USPC ..... 312/334.44
See application file for complete search history.

(56) References Cited

U.S. PATENT DOCUMENTS 3,466,803 A * 9/1969 Packett ..... E05F 11/382 16/93 R
4,935,986 A * 6/1990 Church ..... B60J 1/17 16/93 R
5,181,781 A * 1/1993 Wojcik ..... A47B 88/477 312/334.44

(Continued)

FOREIGN PATENT DOCUMENTS

CN 1215982 A 5/1999
CN 110664141 A 1/2020

(Continued)

OTHER PUBLICATIONS

European Search Report for EP Patent Application No. 23208797.3, Issued on Feb. 7, 2024, 9 pages.

(Continued)

*Primary Examiner* — Christopher Garft
(74) *Attorney, Agent, or Firm* — MEDLER FERRO WOODHOUSE & MILLS PLLC

(57) ABSTRACT

A slide-stop device designed and adapted for wedge engagement with opposing internal sur-faces of a linear motion slide track having an essentially C-shaped cross-sectional profile. The slide-stop device includes two lateral engagement sections extending essentially parallel to the longitudinal direction on opposite sides of the slide-stop device and having engagement surfaces facing outwardly in opposite transverse directions of the slide-stop device, two flex-ion elements being arranged on opposite sides with respect to the longitudinal direction of the slide-stop device. Each of the two flexion elements have one or more strips extending (Continued)

between and connecting the end regions of the lateral engagement sections, each strip being curved or bent to point outwardly with respect to the longitudinal direction of the slide-stop device. At least the strips of the flexion elements are made of elastic material.

14 Claims, 2 Drawing Sheets

(56) References Cited

U.S. PATENT DOCUMENTS

| | | | | |
|---|---|---|---|---|
| 6,254,209 | B1 * | 7/2001 | Parvin | A47B 88/493 312/334.44 |
| 6,280,086 | B1 | 8/2001 | Stijns | |
| 10,206,504 | B2 | 2/2019 | Hutton et al. | |
| 2004/0107535 | A1 * | 6/2004 | Regnier | E05F 11/382 16/93 R |
| 2012/0169199 | A1 * | 7/2012 | Chen | A47B 88/57 312/334.44 |
| 2021/0115971 | A1 * | 4/2021 | Cai | A47B 88/477 |
| 2021/0251385 | A1 * | 8/2021 | Chen | A47B 88/423 |
| 2022/0053933 | A1 * | 2/2022 | Chen | A47B 88/49 |

FOREIGN PATENT DOCUMENTS

| | | | |
|---|---|---|---|
| CN | 112890475 | A | 6/2021 |
| DE | 8114891 | U1 | 8/1981 |
| DE | 60117582 | T2 | 1/2007 |

OTHER PUBLICATIONS

German Search Report received for DE Application No. 102022130217.2, mailed on Jul. 26, 2023, 4 pages of Original Document Only.

* cited by examiner

SLIDE-STOP DEVICE

The application claims priority of German patent application no. 10 2022 130 217.2, filed on Nov. 15, 2022, which is incorporated by reference herein in its entirety.

SUBJECT MATTER OF THE INVENTION

The present invention relates to a slide-stop device designed and adapted for wedge engagement with opposing internal surfaces of a linear motion slide track having an essentially C-shaped cross-sectional profile.

BACKGROUND OF THE INVENTION

Linear motion slides, also referred to as linear guides, are used in various household, automotive and industrial appliances, wherever an object has to be moved along a linear pathway, such as for guidance to cabinet doors, screens, sliding racks, panels or assembly lines. A linear motion slide comprises a track (rail) element and at least one carriage (slide), which is movably seated in or on the track element. In order to enable the slide to be moved relative to the track element with as little friction as possible, rolling bodies are provided between the carriage and the raceways (running surfaces) of the track element. Rolling bodies, such as balls, are usually either distributed and held in a ball cage or in a recirculating guidance or rolling body chain, respectively.

In many cases, the track of a linear motion slide has an essentially C-shaped cross-sectional profile with the raceways for the rolling bodies being arranged on opposing internal surfaces. For installation of an appliance, the track is usually mounted to a wall, corpus or body, and the at least one carriage is inserted into the track together with the rolling bodies. Due to access constraints, only afterwards, an end stop or damper is installed at the end of the track to limit the movement of the carriage and avoid that the carriage runs out of the track in operation of the assembly. Since the installation of the end stop or damper is only the final step to secure the carriage, this often leads to situations during handling and installation, where the carriage rolls out of the track and, since the rolling bodies are not self-retaining in many slides, the carriage and the rolling bodies rapidly disassemble and spread all over the floor.

OBJECT OF THE INVENTION

Therefore, it was an object of the present invention to provide a means, which reduces or avoids the afore-described danger of disassembly of a linear motion slide during installation.

DESCRIPTION OF THE INVENTION

This object is solved by a slide-stop device designed and adapted for wedge engagement with opposing internal surfaces of a linear motion slide track having an essentially C-shaped cross-sectional profile, the slide-stop device comprising two lateral engagement sections extending essentially parallel to the longitudinal direction on opposite sides of the slide-stop device and having engagement surfaces facing outwardly in opposite transverse directions of the slide-stop device, two flexion elements being arranged on opposite sides with respect to the longitudinal direction of the slide-stop device, wherein each of the two flexion elements consists of one or more strips extending between and connecting the end regions of the lateral engagement sections, each strip being curved or bent to point outwardly with respect to the longitudinal direction of the slide-stop device, and wherein at least the strips of the flexion elements are made of elastic material.

Definitions

For description and definition purposes, the slide-stop device of the present invention is defined to have a longitudinal extension in a longitudinal direction, a transverse extension in a transverse direction perpendicular to the longitudinal direction, and a height perpendicular to the longitudinal and transverse directions. The longitudinal direction of the slide-stop device corresponds to the longitudinal extension of the linear motion slide track, when the slide-stop device is wedge engaged with the track. The longitudinal central plane of the slide-stop device of the present invention defines the plane extending in the longitudinal direction and perpendicular to the transverse direction at half of the distance between the lateral sections of the slide-stop device.

The slide-stop device of the present invention is specifically designed and adapted for wedge engagement with the opposing internal surfaces of a linear motion slide track having an essentially C-shaped cross-sectional profile. In general, the opposing internal surfaces of such a track include the raceways and/or surfaces adjacent to the raceways of the track.

The slide-stop device is installed or wedged, respectively, between the open end or free end, respectively, of the track and the carriage, after the carriage has been inserted from the open end into the track together with the rolling bodies. Thereby, the slide-stop device provides a temporary limiter for carriage movement to avoid that the carriage can run out the open end of the track during installation. Then, after the end stop or damper has been installed to the track, the slide-stop device can easily be removed. The design of the inventive slide-stop device allows for a tool and fixing free installation and removal.

In the slide-stop device of the present invention the two lateral engagement sections and the two flexion elements are connected to form a closed structure or ring structure, respectively, whereby they enclose an inner space of the slide-stop device. The two lateral engagement sections extend essentially parallel to the longitudinal direction on opposite sides of the slide-stop device and have engagement surfaces facing outwardly in opposite transverse directions of the slide-stop device. The flexion elements consist of one or more strips of elastic material and being bent to point outwardly with respect to the longitudinal direction of the slide-stop device. This means that the pointing direction of each strip belonging to one flexion element is opposite to the pointing direction of each strip belonging to the other flexion element. The flexion elements allow for compression of the slide-stop device in its transverse direction against the elasticity or tension force of the strips, such that the two lateral engagement sections approach each other and the width of the slide-stop device in the transverse direction becomes smaller. The term elastic, material in the sense of the present invention covers those types of materials that get back to their original shape after getting stretched or compressed by an external force, such as for example rubber, once the force is removed. Preferably, an elastic material in the sense of the present invention is an elastomeric polymer. Suitable elastic materials include silicone, nylon, thermoplastic elastomers (TPE), such as thermoplastic polyamides (TPA). Knowing and considering the herein disclosed invention the skilled person will be able to select a suitable elastic material for the slide-stop device of the present invention.

For installation and wedge engagement of the slide-stop device with the track the slide-stop device is compressed or squeezed to fit between the opposing internal surfaces of the track, and then the compression force is released such that the slide-stop device re-expands and the outwardly facing engagement surfaces of the two lateral engagement sections are pinched against or wedge engaged with the opposing internal surfaces of the linear motion slide track. The wedge engagement between the engagement surfaces of the slide-stop device and the opposing internal surfaces of the track provides a frictional force that avoids movement of the slide-stop device in the longitudinal direction between the opposing internal surfaces of the track.

The flexion elements of the inventive slide-stop device, which consist of one or more strips being curved or bent to point outwardly with respect to the longitudinal direction of the slide-stop device, are designed to increase the frictional force between the engagement surfaces of the slide-stop device and the opposing internal surfaces of the track when a carriage runs against the slide stop device. When the carriage impinges onto a flexion element, the outwardly pointing design of the strips of the flexion elements causes a straightening of the curved or bent strips and thereby an additional transversely directed force onto the lateral engagement sections, which results in an increased gripping pressure and frictional force. The exerted gripping pressure and frictional force increases with increasing impact force applied by the carriage onto the respective flexion element.

It goes without saying that the transverse width of the slide-stop device in the uncompressed state or relaxed state, respectively, must be selected to be broader than the distance between the opposing internal surfaces of the linear motion slide track, for which the slide-stop device is provided, to ensure wedge engagement and sufficient frictional force between the engagement surfaces and the opposing internal surfaces of the track in the installed state of the slide-stop device.

In a preferred embodiment of the slide-stop device according to the invention the curve peak or bending position of each of the curved or bent strips of the pointed sections lies on or near the longitudinal central plane of the slide-stop device. In other words, the distances from the curve peak or bending position of each of the strips to the points of connection of the strip with the two lateral engagement sections on opposite sides of the slide-stop device are equal or nearly equal. This ensures that the transversely directed force exerted by the strip upon straightening due to impingement of the carriage onto a flexion element is equal or about equal in both directions.

Preferably, each of the two angles enclosed by the transverse direction of the slide-stop device and the straight lines through the curve peak or bending position of each strip and through the points where the strip is connected to the end regions of the lateral engagement sections is within the range from 5 to 40 degrees, or from 10 to 30 degrees, or from 15 to 20 degrees, or about 17.5 degrees. The angle defined herein refers to the slide-stop device in the uncompressed state or relaxed state, respectively. If the angle is too small, the increase of the transverse width due to straightening of the strips due to impingement of the carriage onto a flexion element, and thus, the resulting force multiplication, may be too low. If the angle is too high, the leverage force required to straighten the curved or bent strips may be too high. An angle within the range from 10 to 30 degrees, or even more narrow from 15 to 20 degrees, or about 17.5 degrees, has turned out to be a good compromise between force multiplication, leverage force and compactness.

According to the present invention, each flexion element of the slide-stop device consists of at least one single strip extending between and connecting the end regions of the lateral engagement sections. In embodiments of the invention, each flexion element consists of more than one strips, preferably two, three or four curved or bent strips extending between and connecting the end regions of the lateral engagement sections.

Two or more strips of a flexion element are preferably arranged in a row, i. e. one after the other in the longitudinal direction of the slide-stop device. If a flexion element comprises three or more strips, in an embodiment of the invention, all strips are equidistantly spaced. However, in another embodiment of the invention, three or more strips of a flexion element may also be arranged with different distances. In an embodiment comprising three or more strips in one flexion element the strips have decreasing distances from the most outwardly arranged strip, which will get in direct contact with an impinging carriage, towards the most inwardly arranged strip. In another embodiment of the slide-stop device according to the invention comprising two or more strips in one flexion element the strips are interconnected by one or more webs or ribs arranged at or near the curve peaks or bending positions of the strips, such that a force to the most outwardly arranged strip due to impingement of a carriage will immediately be transmitted to the more inwardly arranged interconnected strips.

In another embodiment of the slide-stop device of the present invention, the strips of the flexion elements are provided with holes, bores and/or cut-outs. In Addition to the choice of material, thickness and shape of the strips, such holes, bores and/or cut-outs in one or more of the strips of a flexion element may be suitable to set and adjust the strength and elasticity of each strip in its entirety and/or at specific positions within each strip. Cut-outs extending along the entire length of a strip may result in two or more sub-strips arranged above each other at the same longitudinal position of the device.

As stated above, for installation and wedge engagement of the slide-stop device with the track the slide-stop device is compressed or squeezed to fit between the opposing internal surfaces of the track. Due to the elasticity (resilience) of the flexion elements, at the same time, compression or squeezing builds up a transversely directed return force required for the wedge engagement of the lateral engagement surfaces with the opposing internal surfaces of a linear motion slide track.

Compression or squeezing of the slide-stop device may be done by applying an inwardly directed force onto the two outwardly facing lateral engagement surfaces of the slide-stop device, e. g. by compressing the device between the fingers of an operator. However, this may cause access problems too insert the slide-stop device between the opposing internal surfaces of the track with the fingers still holding the device in the compressed, and thus, pre-biased state.

Therefore, in another preferred embodiment of the present invention, the slide-stop device further comprises at least two handles with at least one handle being arranged on each of the two lateral engagement sections on the opposite side of the outwardly facing engagement surface of the respective lateral engagement section and with the at least two handles being arranged facing each other and at a distance to allow for approaching the handles in the transverse direction of the slide-stop device. The handles are designed for being grasped and pulled together by the fingers of an operator or any other suitable device to draw the two lateral engagement sections together, thereby compressing or squeezing the slide-stop device against the transversely directed return force caused by the flexion elements.

Preferably, the at least two handles are shaped for manual or finger engagement by an operator, such as loop-shaped, D-shaped or blind hole shaped, to allow for manual compression or squeezing of the slide-stop device without the need of any tools. The handles do not only facilitate the installation of the slide-stop device into the track, they even more facilitate the reverse process of removal of the device out of the track.

The blocking force of the inventive slide-stop device against an impinging carriage depends to a large extent from the frictional force between the engagement surfaces of the slide-stop device and the opposing internal surfaces of the track, which in turn depends on the size of the engaging surfaces, their surface properties, such as material, roughness etc., and the gripping pressure in the engaged state. Small and/or smooth engaged surfaces provide less frictional force than large and rough surfaces or surfaces having a friction increasing profile.

Therefore, the present invention includes embodiments of the slide-stop device, wherein the engagement surfaces of the lateral engagement sections have a friction increasing profile, preferably a profile having protrusions, naps, pinches, teeth, spikes, edges, or combinations thereof. For a desired frictional force, applying a friction increasing profile to the engagement surfaces allows to reduce the size of the engagement surfaces, and thus, to reduce the size of the entire device.

To allow compression of the inventive slide-stop device it is essential that at least the strips of the flexion elements are made of elastic material. However, in a preferred embodiment of the present invention the entire slide-stop device is made in one piece of elastic material, such as silicone, polyamide, such as PA6 or PA12.

Suitable methods to manufacture the slide-stop device of the present invention include extrusion moulding, injection moulding and additive manufacturing methods, such as selective laser sintering (SLS) or 3D printing, but are not limited thereto. These methods are particularly suitable for making the slide-stop device of the present invention in one piece of elastic material.

FIGURES

Further advantages, features and possible applications of the present invention will become apparent from the following description of an embodiment according to the invention and the associated figures.

Figure 1:
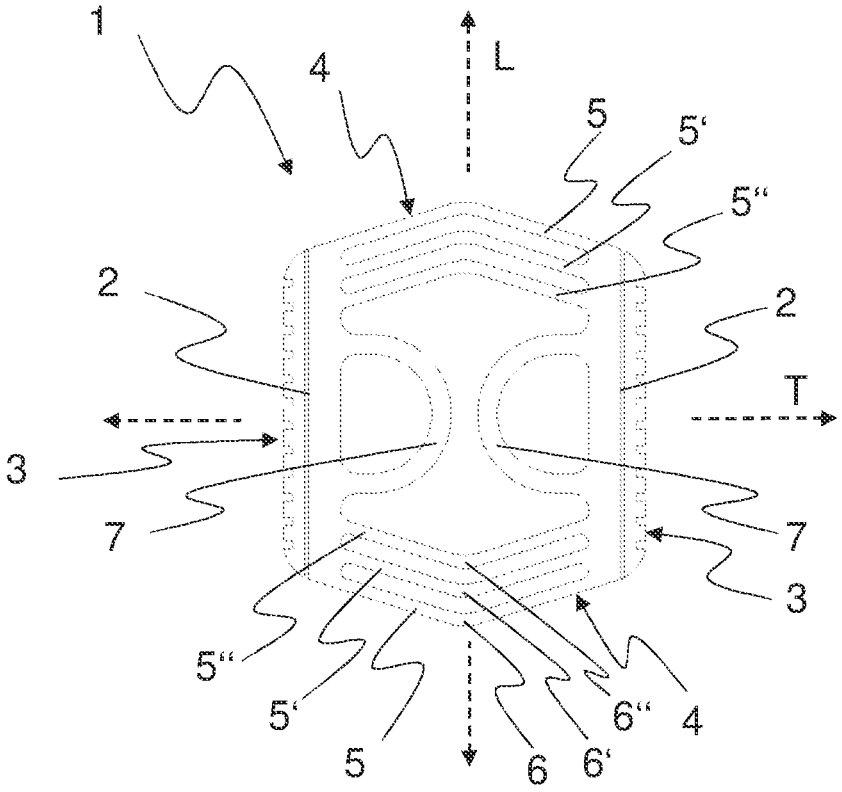
FIG. 1 shows a top view of an embodiment of the slide-stop device of the present invention.
Figure 2:
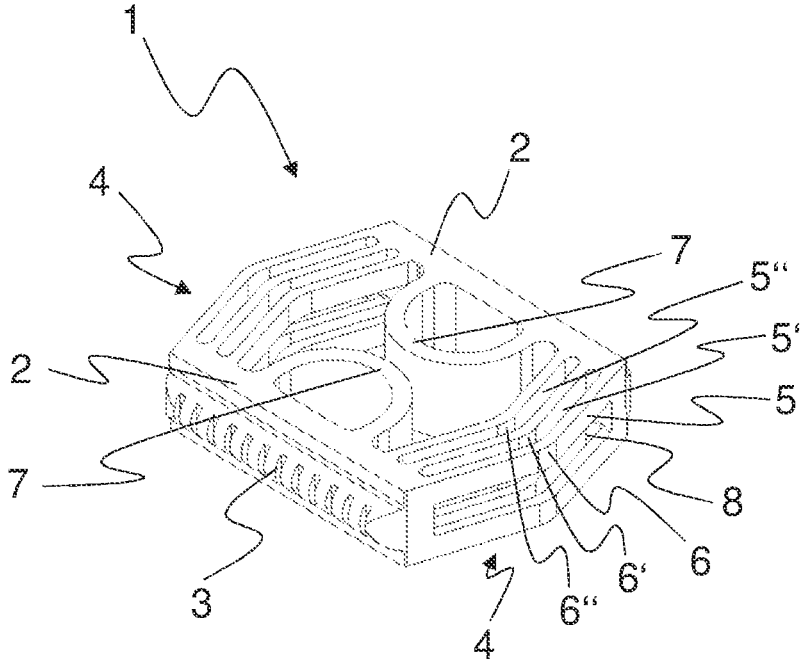
FIG. 2 shows a perspective view of the slide-stop device of FIG. 1.
Figure 3:
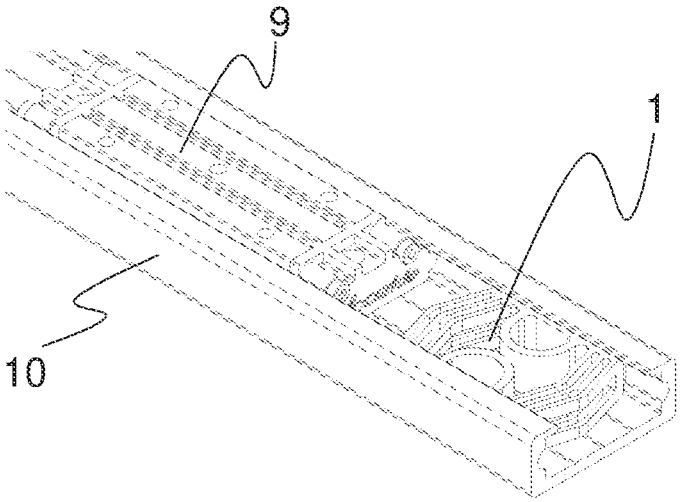
FIG. 3 shows a top view of the slide-stop device of FIG. 1 wedge engaged with a linear motion slide track having an essentially C-shaped cross-sectional profile.
Figure 4:
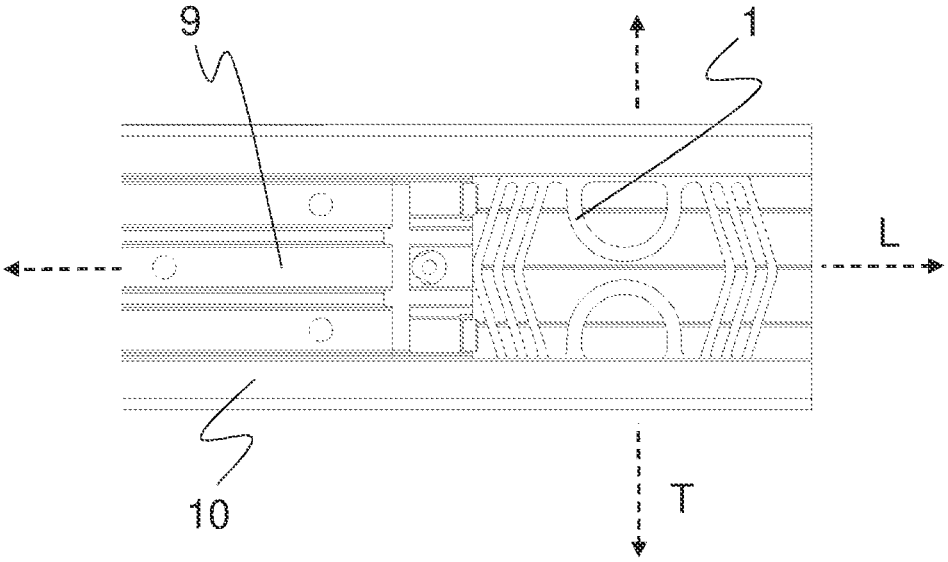
FIG. 4 shows a perspective view of the arrangement of FIG. 3 with the slide-stop device of FIG. 1 wedge engaged with a linear motion slide track having an essentially C-shaped cross-sectional profile.

FIGS. 1 and 2 show views a preferred embodiment of the slide-stop device 1 of the present invention made in one piece of silicone rubber in a selective laser sintering process. FIGS. 3 and 4 show views of a linear motion slide track 10 having an essentially C-shaped cross-sectional profile with a carriage 9 inserted and with the slide-stop device 1 of FIGS. 1 and 2 wedge engaged with the track 10.

The embodiment of the slide-stop device 1 shown in FIGS. 1 to 4 is essentially mirror symmetric with respect to its longitudinal central plane. The two lateral engagement sections 2 of the slide-stop device 1 extend parallel to the longitudinal direction L on opposite sides of the slide-stop device 1 and have engagement surfaces 3 facing outwardly in opposite transverse directions T of the slide-stop device 1. The engagement surfaces 3 of the lateral engagement sections 2 have a surface profile of teeth-like protrusions providing numerous edges to increase the friction when the engagement surfaces 3 are in wedge engagement or contact with the opposing internal surfaces of the track 10.

Each of the two flexion elements 4 arranged on opposite sides with respect to the longitudinal direction L of the slide-stop device 1 consist of three strip 5, 5', 5" extending between and connecting the end regions of the lateral engagement sections 2. Each strip 5, 5', 5" is bent with the bending position 6, 6', 6" of each of the strips 5, 5', 5" lying on the longitudinal central plane of the slide-stop device 1, such that each strip 5, 5', 5" points outwardly with respect to the longitudinal direction L of the slide-stop device 1.

In this embodiment of the slide-stop device 1 the two angles enclosed by the transverse direction T of the slide-stop device 1 and the straight lines through the bending positions (6, 6', 6") of each strip (5, 5', 5") and through the points where the strips are connected to the end regions of the lateral engagement sections 2 are about 17.5 degrees.

The slide-stop device further comprises two D-shaped handles 7 one handle being arranged on each of the two lateral engagement sections 2 on the opposite side of the outwardly facing engagement surface 3 of the respective lateral engagement section 2. The D-shaped handles 7 are designed and provided for finger engagement by an operator to allow for manual compression or squeezing of the slide-stop device during installation to and/or removal from a track without the need of any tools.

For the purposes of the original disclosure, it is pointed out that all features, as they appear to a person skilled in the art from the present description, the drawings and the claims, even if they have been described specifically only in connection with certain specific further features, can be combined both individually and in any combination with other features or groups of features disclosed here, unless this has been expressly excluded or technical circumstances make such combinations impossible or pointless. A comprehensive, explicit description of all conceivable combinations of features is omitted here only for the sake of brevity and readability of the description.

While the invention has been illustrated and described in detail in the drawings and the foregoing description, this description of the invention is given by way of example only and is not intended to limit the scope of protection as defined by the claims. The invention is not limited to the embodiments shown.

Variations of the disclosed embodiments will be obvious to those skilled in the art from the drawings, the description and the appended claims. In the claims, the word "comprising" does not exclude other elements or steps, and the indefinite article "a" does not exclude a plurality. The mere fact that certain features are claimed in different claims does not exclude their combination. Reference signs in the claims are not intended to limit the scope of protection.

REFERENCE LIST

1 slide-stop device
2 lateral engagement sections
3 lateral engagement surfaces
4 flexion elements
5, 5', 5" strips of flexion elements
6, 6', 6" curve peaks bending positions of strips
7 finger handles
8 cut-out in strip
9 carriage
10 track
T transverse direction
L longitudinal direction

The invention claimed is:

1. A slide-stop device designed and adapted for wedge engagement with opposing internal surfaces of a linear motion slide track having an essentially C-shaped cross-sectional profile, the slide-stop device comprising:

two lateral engagement sections extending essentially parallel to the longitudinal direction on opposite sides of the slide-stop device and having engagement surfaces facing outwardly in opposite transverse directions of the slide-stop device, two flexion elements being arranged on opposite sides with respect to the longitudinal direction of the slide-stop device, and at least two handles with at least one handle being arranged on each of the two lateral engagement sections on the opposite side of the outwardly facing engagement surface of the respective lateral engagement section and with the at least two handles being arranged facing each other and at a distance to allow for approaching the handles in the transverse direction of the slide-stop device, wherein each of the two flexion elements consists of one or more strips extending between and connecting the end regions of the lateral engagement sections, each strip being curved or bent to point outwardly with respect to the longitudinal direction of the slide-stop device, and wherein at least the strips of the flexion elements are made of elastic material.

2. The slide-stop device according to claim 1, wherein each of the curved or bent strips has a curve peak or bending position, the curve peak or bending position of each of the curved or bent strips of the flexion elements lies on or near the longitudinal central plane of the slide-stop device.

3. The slide-stop device according to claim 1, wherein each of the curved or bent strips has a curve peak or bending position, wherein the transverse direction of the slide-stop device and two straight lines enclose two angles, wherein one of the two straight lines passes through the curve peak or bending position and through a point where the strip is connected to one of the end regions of the lateral engagement sections and another of the two straight lines passes through the curve peak or bending position and through a point where the strip is connected to another of the end regions of the lateral engagement sections, and wherein each of the two angles is within the range from 5 to 40 degrees.

4. The slide-stop device according to claim 1, wherein each flexion element consists of two, three or four curved or bent strips extending between and connecting the end regions of the lateral engagement sections.

5. The slide-stop device according to claim 1, wherein the at least two handles are shaped for manual or finger engagement by an operator.

6. The slide-stop device according to claim 1, wherein the strips of the flexion elements are provided with holes, bores and/or cut-outs.

7. The slide-stop device according to claim 1, wherein the engagement surfaces of the lateral engagement sections have a friction increasing profile.

8. The slide-stop device according to claim 1, wherein the entire slide-stop device is made in one piece of elastic material.

9. The slide-stop device according to claim 1, wherein the slide-stop device is manufactured by extrusion molding, injection molding or additive manufacturing methods.

10. The slide-stop device according to claim 3, wherein each of the two angles enclosed by the transverse direction of the slide-stop device and the straight lines through the curve peak or bending position of each strip and through the points where the strip is connected to the end regions of the lateral engagement sections is within the range from 10 to 30 degrees.

11. The slide-stop device according to claim 3, wherein each of the two angles enclosed by the transverse direction of the slide-stop device and the straight lines through the curve peak or bending position of each strip and through the points where the strip is connected to the end regions of the lateral engagement sections is within the range from 15 to 20 degrees.

12. The slide-stop device according to claim 5, wherein the at least two handles are loop-shaped, D-shaped or blind hole shaped.

13. The slide-stop device according to claim 1, wherein the engagement surfaces of the lateral engagement sections have protrusions, naps, pinches, teeth, spikes, edges, or combinations thereof.

14. The slide-stop device according to claim 8, wherein the elastic material-is silicone or polyamide.

* * * * *